United States Patent [19]

Hosaka et al.

[11] 4,171,690

[45] Oct. 23, 1979

[54] EMISSION CONTROL SYSTEM FOR INTERNAL COMBUSTION ENGINES UTILIZING BALANCE DIFFERENTIAL AMPLIFIER STAGE

[75] Inventors: Akio Hosaka, Yokohama; Makoto Anzai, Yokosuka, both of Japan

[73] Assignee: Nissan Motor Company, Limited, Japan

[21] Appl. No.: 775,407

[22] Filed: Mar. 7, 1977

[30] Foreign Application Priority Data

Mar. 8, 1976 [JP] Japan ..... 51/24110

[51] Int. Cl.[2] ..... F02B 3/00

[52] U.S. Cl. ..... 123/119 EC; 123/32 EE; 123/32 ED

[58] Field of Search ..... 123/32 EA, 32 EE, 119 EC, 123/32 ED; 60/276, 285

[56] References Cited

U.S. PATENT DOCUMENTS

| | | | |
|---|---|---|---|
| 3,745,768 | 7/1973 | Zechmall et al. | 60/285 |
| 3,759,232 | 9/1973 | Wahl et al. | 123/32 EA |
| 3,815,560 | 6/1974 | Wahl et al. | 123/32 EA |
| 3,815,561 | 6/1974 | Seitz | 60/276 |
| 3,825,237 | 8/1974 | Linder et al. | 60/285 |
| 3,855,974 | 12/1974 | Mayer | 123/119 EC |
| 4,029,061 | 6/1977 | Asano | 60/285 |
| 4,030,462 | 6/1977 | Sasayama et al. | 60/285 |
| 4,073,269 | 2/1978 | Herth et al. | 60/276 |
| 4,075,982 | 2/1978 | Asano et al. | 123/119 EC |
| 4,089,313 | 5/1978 | Asano et al. | 123/119 EC |

*Primary Examiner*—Samuel W. Engle
*Assistant Examiner*—S. A. Cangialosi
*Attorney, Agent, or Firm*—Lowe, King, Price & Becker

[57] ABSTRACT

A closed-loop emission control system for an internal combustion engine having an exhaust composition sensor includes an averaging circuit for generating a signal representative of the average value of the sensed exhaust composition, and a balanced differential amplifier receptive of the average and instantaneous values of the sensed composition to generate an output indicating the difference therebetween. A DC bias is applied to the differential amplifier to fluctuate the difference signal above and below the DC bias level.

7 Claims, 7 Drawing Figures

EMISSION CONTROL SYSTEM FOR INTERNAL COMBUSTION ENGINES UTILIZING BALANCE DIFFERENTIAL AMPLIFIER STAGE

FIELD OF THE INVENTION

The present invention relates generally to emission control systems for internal combustion engines and in particular to such systems in which error correction signal fluctuates above and below a predetermined DC level which assures an appropriate air-fuel ratio when exhaust composition sensor operates under unfavorable conditions.

SUMMARY OF THE INVENTION

An object of the invention is to provide an emission control system for an internal combustion engine having an exhaust composition sensor, which system comprises an averaging circuit for generating a signal indicating the average value of the sensed composition, a balanced differential amplifier stage for generating a signal representing the difference between the instantaneous value of the sensed composition and its average value, and means for biasing the differential amplifier at a predetermined DC voltage so that the output from the differential amplifier fluctuates above and below the DC voltage.

Another object of the invention is to provide an emission control system in which the air-fuel ratio is clamped to an appropriate value when the output from the sensor is inappropriate for feedback control.

A further object of the invention is to extend the usable lifetime of the exhaust composition sensor.

A still further object of the invention is to provide an emission control system which is operative under noise prevalent environment.

DESCRIPTION OF THE PREFERRED EMBODIMENTS

Figure 1:
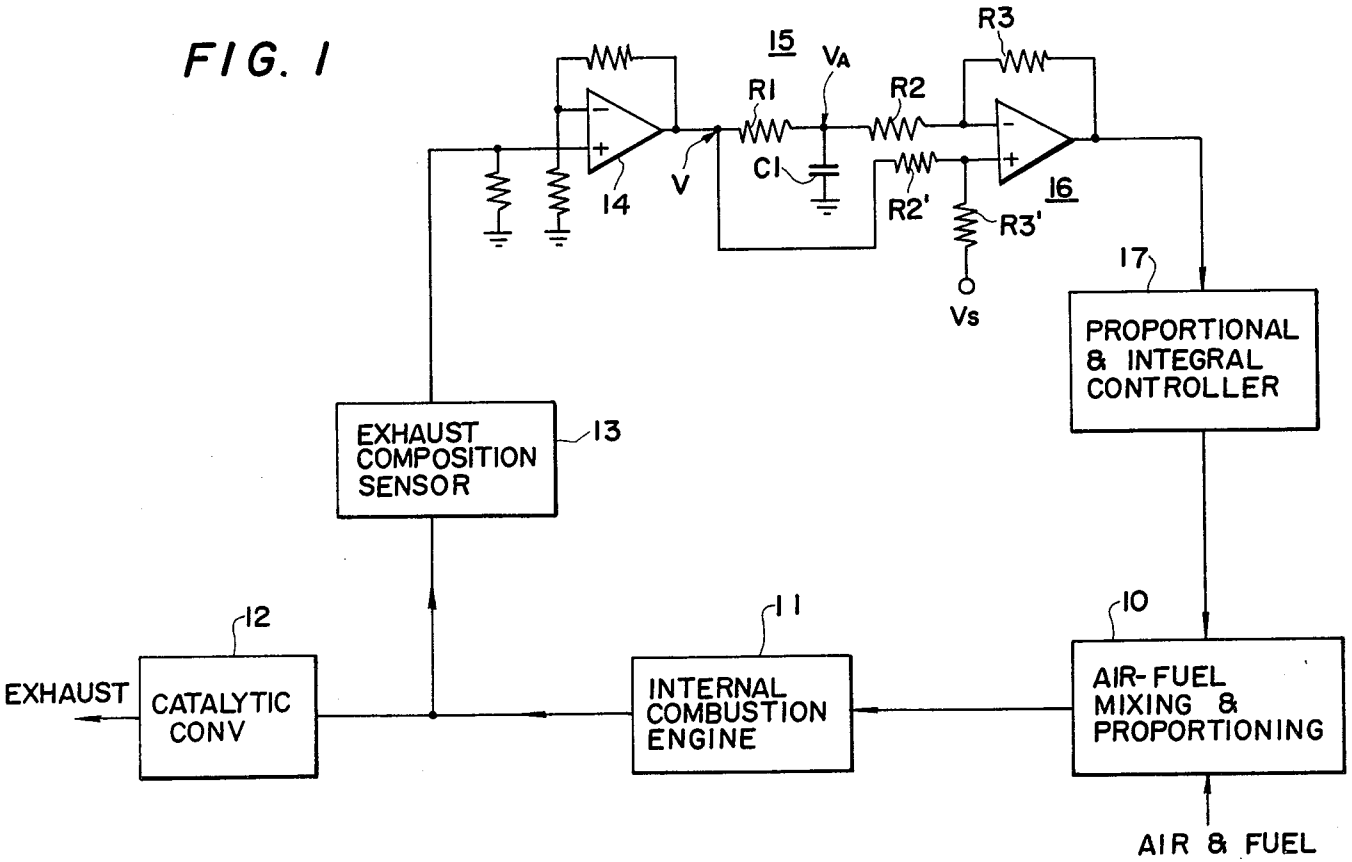
FIG. 1 is a first embodiment of the invention.

Referring now to FIG. 1, air-fuel mixing and proportioning device 10 delivers air-fuel mixture to the cylinders of the internal combustion engine 11. The mixture is combusted and exhausted through a catalytic converter 12 disposed in the exhaust passage. An exhaust composition sensor such as oxygen sensor 13 is provided at the upstream side of the catalytic converter to detect the concentration of the residual oxygen in the emissions and provides an output representative of the sensed oxygen concentration to a DC buffer amplifier 14. The output of the buffer amplifier 14 is connected to an averaging circuit or RC filter 15 formed by a resistor R1 and a capacitor C1 connected to ground to constitute an input to the inverting input of operational amplifier 16 through a resistor R2. The output from the buffer amplifier 14 is also connected to the noninverting input of the operational amplifier 16 through resistor R2' having the same resistance value as the resistor R2. By connecting the inverting input and the output by means of a resistor R3 and connecting the noninverting input to a source of voltage $V_S$ through a resistor R3' of equal resistance to resistor R3, the operational amplifier 16 acts as a balanced differential amplifier. The output from the balanced differential amplifier 16 is supplied to a proportional/integral controller 17 in which the amplitude of the input signal is modified in accordance with the proportional and integral control characteristics to provide error correction signal to the air-fuel mixing and proportioning device 10.

In operation, the air-fuel mixture ratio is controlled by the feedback signal from the controller 17 at a desired value which is normally in the vicinity of stoichiometry at which the noxious emissions (CO, HC, NOx) are simultaneously converted into harmless products at the maximum conversion efficiency by the catalytic converter 12.

The output from the exhaust composition sensor 13 represents the sensed oxygen concentration, but its amplitude tends to oscillate because of the inherent system's delay time in responding to the input thereto even though the vehicle is under normal steady driving. The amplified oxygen-representative signal V is filtered through the RC filter circuit 15 and the voltage $V_A$ across the capacitor C1 represents the average or mean value of the varying sensed oxygen concentration. This mean value serves as a reference for the differential amplifier 16 to generate an output to indicate the deviation of the instantaneous value of the sensed oxygen concentration from the average oxygen concentration.

Figure 2:
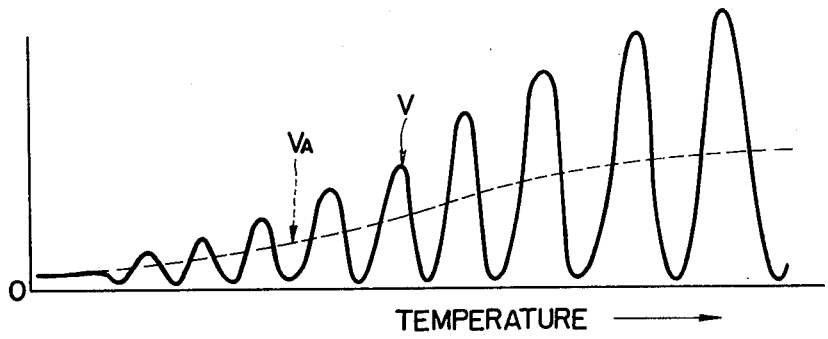
FIG. 2 is a waveform of the output from the exhaust composition sensor.

Since the impedance of the oxygen sensor 13 varies as a function of exhaust gas temperature as well as a function of time over a substantial period of use, the average value of the sensed oxygen concentration is an indication of such factors affecting the operating performance of the sensor 13. Therefore, the voltage $V_A$ can be used to compensate for errors resulting from the changing performance of the sensor so that its operating temperature range and its usable life time can be extended. As illustrated in FIG. 2, the upper peak values of the sensed concentration represented by voltage V varies as a function of exhaust gas temperature, while its lower peak values are constantly at the zero voltage level, and therefore the voltage waveform $V_A$ varies as a function of the exhaust gas temperature.

Figure 3:
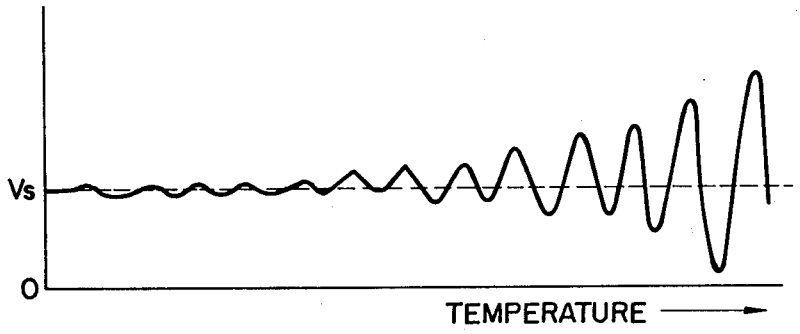
FIG. 3 is a waveform of the output from the balanced differential amplifier.

Consider now the detail of the balanced differential amplifier 16. Assume that resistances R2=R2'=R3=R3', then the operational amplifier 16 operates as a unity gain amplifier. If the voltage $V_S$ is $\frac{1}{2}$ of the maximum peak amplitude of the voltage V, the output from the differential amplifier 16 is $V_D = V_S + R3/R2(V - V_A) = V_S + (V - V_A)$. Since the value in the parentheses represents the difference between the input voltage applied to the differential amplifier, the output $V_D$ from amplifier 16 fluctuates above and below the constant DC potential $V_S$ by the amount proportional to the difference $(V - V_A)$ as illustrated in FIG. 3.

Figure 4:
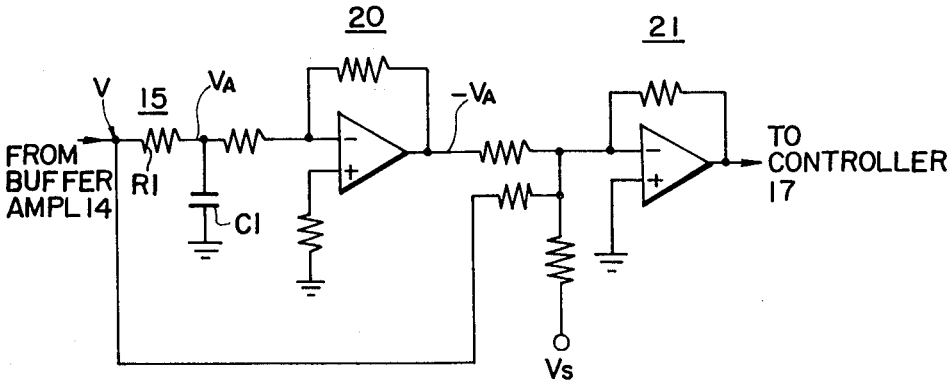
FIG. 4 is an alternative embodiment of the invention.

FIG. 4 is an alternative embodiment of the invention in which the output from the averaging circuit 15 is polarity-inverted by an inverter 20 and applied to the inverting input of a summation amplifier 21. To the inverting input of amplifier 21 are connected the output from the buffer amplifier 14 and a DC voltage source $V_S$. The noninverting input of the summation amplifier is connected to ground. Amplifier 21 combines these input voltages to generate an output having the amplitude characteristic as in the previous embodiment.

Figure 5:
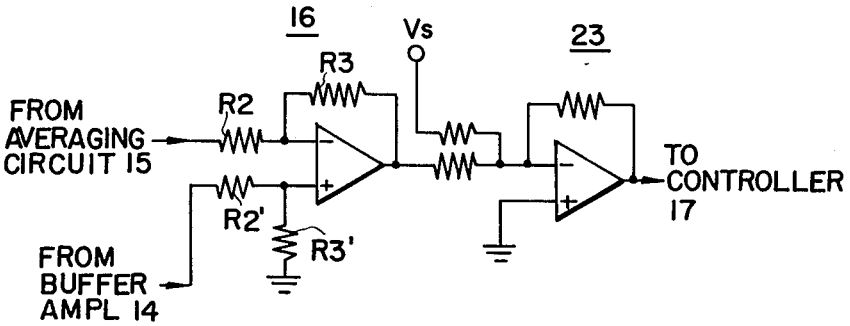
FIG. 5 is a further alternative embodiment of the invention.

Alternatively, the differential amplifier 16 of FIG. 1 can be arranged as shown in FIG. 5 in which the noninverting input is connected to the ground potential instead of to the positive DC supply $V_s$, so that its output fluctuates above and below the zero potential level by the amount proportional to the difference between the two input voltage and is applied to a summation amplifier 23 to which is also applied a DC voltage from source $V_s$. Therefore, the output from the summation amplifier 23 is a voltage fluctuating above and below the DC bias from source $V_s$.

Figure 6:
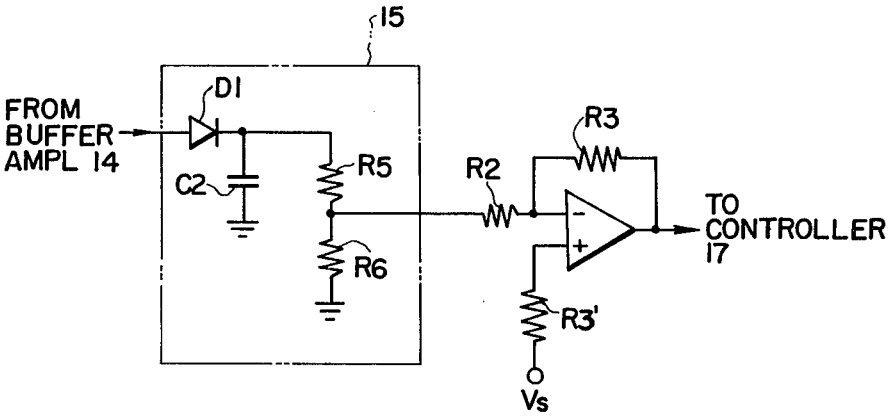
FIG. 6 is a modification of the averaging circuit of FIG. 1.

The averaging circuit 15 can be modified in FIG. 6 in which the circuit 15 is shown as comprising peak detector formed by a diode D1 with its anode connected to the output of buffer amplifier 14 and a capacitor C2 connected to the cathode of the diode. A voltage divider consisting of series-connected resistors R5 and R6 is connected between the cathode of diode D1 and ground. The point intermediate the resistors R5, R6 is connected to the balanced differential amplifier 16 through resistor R2. The capacitor C2 is charged through diode D1 as long as the potential at the output from buffer amplifier 14 is higher than the potential across the capacitor C2. When peak voltage is reached the voltage across the capacitor C2 will exponentially decrease through the series-connected resistors R5, R6. The time constant C2(R5+R6) is selected such that the voltage across capacitor C2 will remain substantially constant during the period between successive peak voltages of the sensed oxygen concentration. The voltage across capacitor C1 is then reduced to a value determined by the ratio of the two resistors R5, R6 so that the voltage at the intermediate point of the voltage divider represents substantially the average value of the sensed oxygen concentration.

Since the input signal to the controller 17 is arranged to fluctuate above and below the predetermined DC voltage level, the control point will be clamped to the DC level when invalid signal is delivered from the exhaust composition sensor during its unfavorable operating conditions such as cold engine start.

Because of the balanced circuit arrangement. The noise components are cancelled out in the differential amplifier output.

Since the output from the balanced differential amplifier 16 is an indication of the difference between the average value of the sensed oxygen content and its instantaneous value, the error resulting from the changing operating performance of the sensor can be compensated for so that its usable lifetime can be prolonged.

Figure 7:
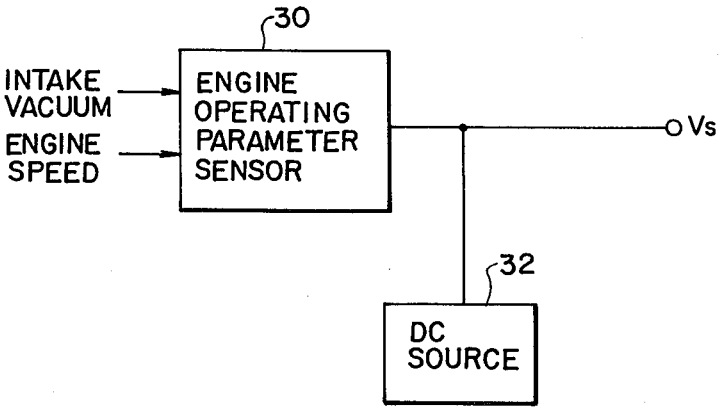
FIG. 7 is a further modification of the invention.

The DC voltage source Vs may be obtained from an engine operating parameter sensor 30 shown in FIG. 7. The sensor 30 detects various engine operating parameters such as intake vacuum and engine speed and generates a corresponding electrical signal which is superimposed over a DC voltage from a DC source 32. Therefore, the output voltage Vs can be varied in accordance with the sensed engine conditions. If idling condition is detected by sensor 30, the output voltage Vs will vary accordingly to a value which is most suitable for such engine operating condition. Therefore, upon occurrence of a failure of the composition sensor 13, the output voltage Vs will not be affected by the sensor 30 and the air-fuel ratio is controlled at a value which is only suitable for such failed condition. This arrangement is particularly advantageous when air-fuel ratio deviates from the stoichiometric value for an extended period of time due to the occurrence of an external disturbance such as sudden acceleration or deceleration since the sensed engine parameter will cause the DC bias voltage Vs to vary to forcibly bring the controlled air-fuel ratio to a suitable value.

What is claimed is:

1. An emission control system for an internal combustion engine having an air-fuel mixing and proportioning device for delivery of proportioned air-fuel mixture to the cylinder of said engine in accordance with a low level noise and long term drift compensated error correction signal, comprising:

an exhaust composition sensor for sensing the concentration of an exhaust composition of the emissions from said engine to generate a first signal representative of the sensed concentration;

means for generating said compensated error correction signal; and means for controlling the air-fuel mixing and proportioning device in response to said compensated error correction signal;

said compensated error correction signal generating means comprising:

(a) means for generating a second signal substantially representative of a mean value of said first signal;

(b) means for generating a third signal representative of the difference in amplitude between said first and second signals;

(c) means for combining said third signal with a predetermined DC voltage having a level higher than noise so that said third signal fluctuates above and below said DC voltage; and (d) means for modifying the amplitude of said combined signal in accordance with a predetermined control characteristic to generate said compensated error correction signal.

2. An emission control system as claimed in claim 1, wherein said third signal generating means and said combining means comprise an operational amplifier having a first and a second input connected through a first and second resistors of equal resistance values to the outputs of said second signal generating means and said exhaust composition sensor respectively, said first input being further connected through a third resistor to the output thereof, and said second input being biased at said predetermined DC voltage through a fourth resistor, wherein said third and fourth resistors have equal resistance values.

3. An emission control system as claimed in claim 1, wherein said third signal generating means and said combining means comprise an inverter for inverting the polarity of one of the outputs of said second signal generating means and said exhaust composition sensor, a source of DC potential at said predetermined voltage, and a summation amplifier receptive of said polarity-inverted signal, the other of said signals which is not inverted in polarity and said DC voltage.

4. An emission control system as claimed in claim 1, wherein said third signal generating means and said combining means comprise an operational amplifier having a first and a second input connected through a first and a second resistors of equal resistance values to the outputs said second signal generating means and said exhaust composition sensor respectively, said first input being further connected through a third resistor to the output thereof, said second input being biased at ground potential through a fourth resistor, wherein said third and fourth resistors have equal resistance values, and a summation amplifier receptive of the output from said operational amplifier and a DC voltage of said predetermined value.

5. An emission control system as claimed in claim 1, wherein said second signal generating means comprises a peak detector connected to the output from said exhaust composition sensor and a voltage divider connected between said peak detector and ground, the output from said voltage divider being connected to said third signal generating means.

6. An emission control system as claimed in claim 5, wherein said peak detector comprises a diode and a capacitor series connected between the output from said exhaust composition sensor and ground, the point intermediate said diode and capacitor being connected to said voltage divider.

7. An emission control system as claimed in claim 1, further comprising means for sensing an engine operating parameter to generate a corresponding electrical signal and means for varying said DC voltage in accordance with said generated electrical signal.

* * * * *